US011965694B2

(12) United States Patent
Cortale et al.

(10) Patent No.: US 11,965,694 B2
(45) Date of Patent: Apr. 23, 2024

(54) PROCESS AND APPARATUS FOR THE CRYOGENIC SEPARATION OF A MIXTURE OF CARBON MONOXIDE, HYDROGEN AND METHANE FOR THE PRODUCTION OF CH4

(71) Applicant: L'Air Liquide, Societe Anonyme pour l'Etude et l'Exploitation des Procedes Georges Claude, Paris (FR)

(72) Inventors: Manon Cortale, Vincennes (FR); Bertrand Demolliens, Paris (FR); Antoine Hernandez, Saint Maur des Fosses (FR); Guillaume Teixeira, Paris (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 1078 days.

(21) Appl. No.: 16/520,878

(22) Filed: Jul. 24, 2019

(65) Prior Publication Data

US 2020/0033055 A1 Jan. 30, 2020

(30) Foreign Application Priority Data

Jul. 25, 2018 (FR) ..... FR 1856889

(51) Int. Cl.
*F25J 3/02* (2006.01)

(52) U.S. Cl.
CPC ..... *F25J 3/0223* (2013.01); *F25J 3/0252* (2013.01); *F25J 3/0257* (2013.01); *F25J 3/0261* (2013.01);
(Continued)

(58) Field of Classification Search
CPC ..... F25J 3/0223; F25J 3/0252; F25J 3/0257; F25J 3/0261; F25J 3/0271; F25J 3/0276; F25J 2205/04; F25J 2210/06; F25J 2210/42; F25J 2215/04; F25J 2200/40; F25J 2200/72; F25J 2200/74; F25J 2205/50;
(Continued)

(56) References Cited

U.S. PATENT DOCUMENTS 2,692,484 A 10/1954 Etienne
2,722,113 A * 11/1955 Deming ..... B01D 3/146 62/628
(Continued)

FOREIGN PATENT DOCUMENTS

BR PI1104609 A2 * 4/2013 ..... F25J 1/00
CN 101 688 753 3/2010
(Continued)

OTHER PUBLICATIONS

French Search Report and Written Opinion for FR 1856889, dated Apr. 16, 2019.

*Primary Examiner* — John F Pettitt, III
(74) *Attorney, Agent, or Firm* — Justin K. Murray

(57) ABSTRACT

In a process of the separation of a mixture of carbon monoxide, hydrogen and methane, the mixture is sent to a scrubbing column, a bottom liquid withdrawn at the bottom of the scrubbing column is depleted in hydrogen with respect to the mixture and is sent to a stripping column, a bottom liquid from the stripping column is sent to a separation column and a liquid enriched in methane withdrawn from the bottom of the separation column is vaporized in order to form a final product.

15 Claims, 7 Drawing Sheets

(52) U.S. Cl.
CPC ..... *F25J 3/0271* (2013.01); *F25J 3/0276* (2013.01); *F25J 2200/30* (2013.01); *F25J 2200/70* (2013.01); *F25J 2200/76* (2013.01); *F25J 2205/04* (2013.01); *F25J 2210/06* (2013.01); *F25J 2210/42* (2013.01); *F25J 2215/04* (2013.01)

(58) Field of Classification Search
CPC .. F25J 2200/30; F25J 2200/70; F25J 2270/02; F25J 2270/12; F25J 2270/24; F25J 2270/42; F25J 2270/88; F25J 2290/40; F25J 2290/62; F25J 3/0233; F25J 3/0209; F25J 5/00; F25J 2215/10; F25J 2215/14; F25J 2215/60; C10L 3/10
See application file for complete search history.

(56) References Cited

U.S. PATENT DOCUMENTS 3,407,146 A * 10/1968 Becker ..... C01B 3/025 62/934
3,656,312 A * 4/1972 Streich ..... F25J 3/0257 62/928
4,488,890 A * 12/1984 Foerg ..... F25J 3/0271 62/635
5,295,356 A * 3/1994 Billy ..... C07C 7/04 62/623
5,609,040 A * 3/1997 Billy ..... F25J 3/04587 62/622
5,617,741 A * 4/1997 McNeil ..... F25J 3/0257 62/622
5,832,747 A * 11/1998 Bassett ..... F25J 3/0261 62/931
6,289,693 B1 * 9/2001 O'Brien ..... C01B 3/38 62/53
8,869,553 B2 * 10/2014 Court ..... G01M 17/0078 62/920
2009/0277217 A1 * 11/2009 Ransbarger ..... F25J 3/0233 62/619
2010/0162754 A1 * 7/2010 Billy ..... F25J 3/0233 62/617
2012/0279254 A1 * 11/2012 Darde ..... F25J 3/0261 62/617
2013/0298600 A1 * 11/2013 Hernandez ..... F25J 3/0276 62/617
2014/0090416 A1 * 4/2014 McNeil ..... F25J 3/0261 62/618
2015/0047390 A1 * 2/2015 Darde ..... F25J 3/0266 62/617
2016/0153710 A1 * 6/2016 McNeil ..... F25J 3/0252 62/625
2018/0209726 A1 * 7/2018 Caruso ..... F25J 3/0266
2020/0191477 A1 * 6/2020 Mak ..... F25J 3/0242
2021/0055048 A1 * 2/2021 Hernandez ..... F25J 3/0233

FOREIGN PATENT DOCUMENTS

CN 105 371 592 3/2016
CN 107 367 127 11/2017
EP 0 677 483 10/1995
FR 2 754 541 4/1998
FR 3 011 320 4/2015
FR 3011320 A1 * 4/2015 ..... F25J 3/0223
FR 3 018 599 9/2015

* cited by examiner

PROCESS AND APPARATUS FOR THE CRYOGENIC SEPARATION OF A MIXTURE OF CARBON MONOXIDE, HYDROGEN AND METHANE FOR THE PRODUCTION OF CH4

CROSS REFERENCE TO RELATED APPLICATIONS

This application claims the benefit of priority under 35 U.S.C. § 119 (a) and (b) to French patent application No. FR1856889, filed Jul. 25, 2018, the entire contents of which are incorporated herein by reference.

FIELD OF THE INVENTION

The present invention relates to a process and to an apparatus for the cryogenic separation of a mixture of carbon monoxide, hydrogen and methane for the production of methane.

BACKGROUND OF THE INVENTION

Synthesis gas contains carbon monoxide, hydrogen and methane and these three components are preferably the main components of synthesis gas.

The gas can also contain nitrogen and/or argon.

Units for the production of carbon monoxide and hydrogen can be separated into two parts:

generation of synthesis gas (mixture containing $H_2$, CO, $CH_4$ essentially and also possibly $CO_2$ and/or Ar and/or $N_2$ essentially). Among the various industrial routes for the production of synthesis gas, that based on coal gasification appears to be increasingly expanding, in particular in countries rich in deposits of coal, such as China. The process for the partial oxidation of natural gas can also prove to be advantageous for the production of CO, alone or with low $H_2$/CO production ratios. Another route is steam reforming.

purification of synthesis gas. The following are found:

A unit for scrubbing with a liquid solvent in order to remove most of the acid gases present in the synthesis gas.

A unit for purification on a bed of adsorbents.

A unit for separation by the cryogenic route, referred to as cold box route, for the production of CO.

The patents below describe schemes with a first stage of scrubbing with CO (pure or impure), a stripping stage and a CO/$CH_4$ separation column.

Scrubbing with pure CO with CO pump+$N_2$ cycle: CN101688753.

Scrubbing with impure CO+$H_2$ turbines, no cycle compressor: FR 2 754 541.

The disadvantage of the CN101688753 process is that it uses carbon monoxide pumps and also a reboiler at the bottom of the CO/$CH_4$ column.

The disadvantage of the partial condensation scheme described in FR 2 754 541 is that the hydrogen-rich gas is produced at low pressure. A reboiler is present at the bottom of the CO/$CH_4$ column.

SUMMARY OF THE INVENTION

The apparatus according to an embodiment of the invention preferably comprises a cold box with regard to a process for scrubbing with impure CO where the separation energy is contributed by $N_2$ cycle and/or by $CH_4$ cycle.

According to an embodiment of the invention, there is provided a process for the separation of a mixture of carbon monoxide, hydrogen and methane, in which:

i) the mixture cooled to a cryogenic temperature in a heat exchanger, or a gaseous or liquid fluid derived from this mixture, is sent to a scrubbing column fed at the top with a liquid containing at least 80 mol % of carbon monoxide and/or to at least one phase separator, ii) a bottom liquid withdrawn at the bottom of the scrubbing column or of the phase separator or of one of the phase separators is depleted in hydrogen with respect to the mixture and is sent to a stripping column, iii) a gas is withdrawn at the top of the stripping column, iv) a bottom liquid from the stripping column is sent to a separation column, and v) a liquid enriched in methane is withdrawn from the bottom of the separation column and vaporized in the heat exchanger in order to form a final product, characterized in that the vaporized liquid enriched in methane is compressed in a compressor and a part of the compressed gas is returned at the bottom of the separation column in order to be separated therein.

According to other optional aspects:

the part of the compressed gas is at a lower pressure than that of the compressed final product, the scrubbing column is fed at the top with a liquid originating from a condenser where at least a part of the gas from the top of the scrubbing column or originating from the top of the separation column or originating from a cycle for refrigeration with carbon monoxide is condensed, the mixture contains nitrogen and the separation column produces, at the bottom, the liquid enriched in methane and depleted in carbon monoxide and, at the top, a gas enriched in carbon monoxide, the separation column has a top condenser cooled by a closed nitrogen cycle comprising a gaseous nitrogen compressor, the separation column is cooled at the top by a carbon monoxide cycle, a carbon monoxide cycle provides the process with cold, the carbon monoxide cycle produces a product rich in carbon monoxide, the carbon monoxide cycle provides the scrubbing column with a scrubbing liquid, the nitrogen cycle is used to reboil the stripping column, the maximum pressure of the nitrogen cycle is less than the critical pressure of the nitrogen, the maximum pressure of the carbon monoxide cycle is less than the critical pressure of the carbon monoxide, the maximum pressure of the nitrogen or carbon monoxide cycle is chosen so that the condensation temperature of nitrogen or carbon monoxide in the heat exchanger at this pressure is greater by less than approximately 10° C. than the vaporization temperature of the liquid methane in the heat exchanger, the maximum pressure of the nitrogen or carbon monoxide cycle is chosen so that the condensation temperature of nitrogen or carbon monoxide in the heat exchanger at this pressure is greater by at least 2° C. than the vaporization temperature of the liquid methane in the heat exchanger, the mixture or a gas derived from the mixture is used to reboil the stripping column, the separation column operates at between 7 and 10 bars abs, the separation column does not comprise a bottom reboiler, gaseous methane is produced as final product at at least 25 bars abs, the scrubbing column operates at between 15 and 60 bars absolute, the stripping column operates at between 3 and 20 bars absolute, the separation column operates at between 1.5 and 15 bars absolute, preferably between 7 and 10 bars absolute, the stationary phase for vaporization of the liquid methane is at between −155° C. and −150° C., the stationary phase for vaporization of the liquid methane is found opposite the stationary phase for condensation of the nitrogen originating from the compressor, the stationary phase for condensation of the nitrogen is found between −155° C. and −150° C.

The maximum pressure of the nitrogen cycle (outlet pressure of V4) is preferably 35 bars absolute (critical pressure of the nitrogen). The process is possible with a pressure which is greater and up to 70 bars but less effective if above the critical pressure of the nitrogen.

According to another subject-matter of the invention, an apparatus for the separation of a mixture of carbon monoxide, hydrogen and methane is provided which comprises a scrubbing column and/or at least one phase separator, a stripping column and a separation column, a heat exchanger, means for sending the mixture to be cooled to a cryogenic temperature to the heat exchanger, means for sending the cooled mixture or a fluid derived from this mixture to the scrubbing column fed at the top with a liquid containing at least 80 mol % of carbon monoxide and/or to the phase separator or to at least one of the phase separators, means for withdrawing a bottom liquid depleted in hydrogen with respect to the mixture of the scrubbing column or of the phase separator or of one of the phase separators, means for sending the withdrawn liquid to the stripping column, means for withdrawing a gas at the top of the stripping column, means for sending a bottom liquid from the stripping column to the separation column, means for withdrawing a liquid enriched in methane from the bottom of the separation column and means for vaporizing the withdrawn liquid in the heat exchanger in order to form a final product, characterized in that it comprises a compressor, means for sending the vaporized liquid enriched in methane to be compressed in the compressor and means for returning a part of the gas compressed in the compressor at the bottom of the separation column in order to be separated therein.

Preferably:

the apparatus comprises a cycle for refrigeration with nitrogen or carbon monoxide, the apparatus comprises a closed refrigeration cycle, the separation column has a top condenser, preferably cooled by a/the refrigeration cycle, the separation column is surmounted by a reservoir of the liquid of the refrigeration cycle, the separation column is surmounted by a reservoir of liquid nitrogen or of liquid carbon monoxide, the scrubbing column is surmounted by a top gas condenser, the scrubbing column is fed with a liquid rich in carbon monoxide originating from the top of the separation column and/or from the reservoir or from a storage of liquid and/or from the refrigeration cycle, the apparatus comprises two phase separators and means for sending the gas from the first phase separator to the second phase separator, the apparatus comprises a phase separator, preferably a single phase separator upstream of the scrubbing column, the means for returning a part of the gas compressed in the compressor at the bottom of the separation column are connected to the heat exchanger, Any feature mentioned above can be combined with any other characteristic within the limits of logic and science.

According to an alternative form of the invention, the $CH_4$ is produced in the gaseous form at a pressure of greater than 25 bars, indeed even than 30 bars, absolute.

The compressor of $CH_4$ produced is also used for the $CH_4$ cycle. The reboiling energy of the $CO/CH_4$ column is contributed by direct injection at the bottom of the column of a gaseous $CH_4$ circuit coming from the $CH_4$ compressor after cooling in the exchange line. The vaporization of $CH_4$ at low pressure contributes the refrigeration for the cooling of the $N_2$ cycle, the $CH_4$ vaporized at low pressure coming from the bottom of the $CO/CH_4$ column and/or from the $CH_4$ cycle.

This scheme makes possible a significant recovery of $CH_4$ without the use of CO pumps or of a CO compressor, the $CH_4$ cycle making it possible not to have a reboiler at the bottom of the $CO/CH_4$ column and a better thermal integration at the main exchanger. As the $CO/CH_4$ column is operated at between 7 and 10 bars approximately, the solutions of the state of the art with reboiling with syngas or nitrogen exhibit the disadvantage that the reboiling contribution is either by sensible heat or else requires greatly increasing the pressure of the $N_2$ cycle above the critical pressure of the nitrogen.

Two alternatives are provided for overcoming this problem: the reboiling of the stripping column with synthesis gas or else with gaseous nitrogen at high pressure.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims the way in which said claims refer back to one another.

DETAILED DESCRIPTION OF THE INVENTION

The invention will be described in more detail with reference to FIGS. 1, 2, 4, 5, 6 and 7, which represent processes according to the invention, and to FIG. 3, which represents the exchange of heat between the fluids which are cooled and the fluids which are heated in the heat exchanger E1.

Figure 1:
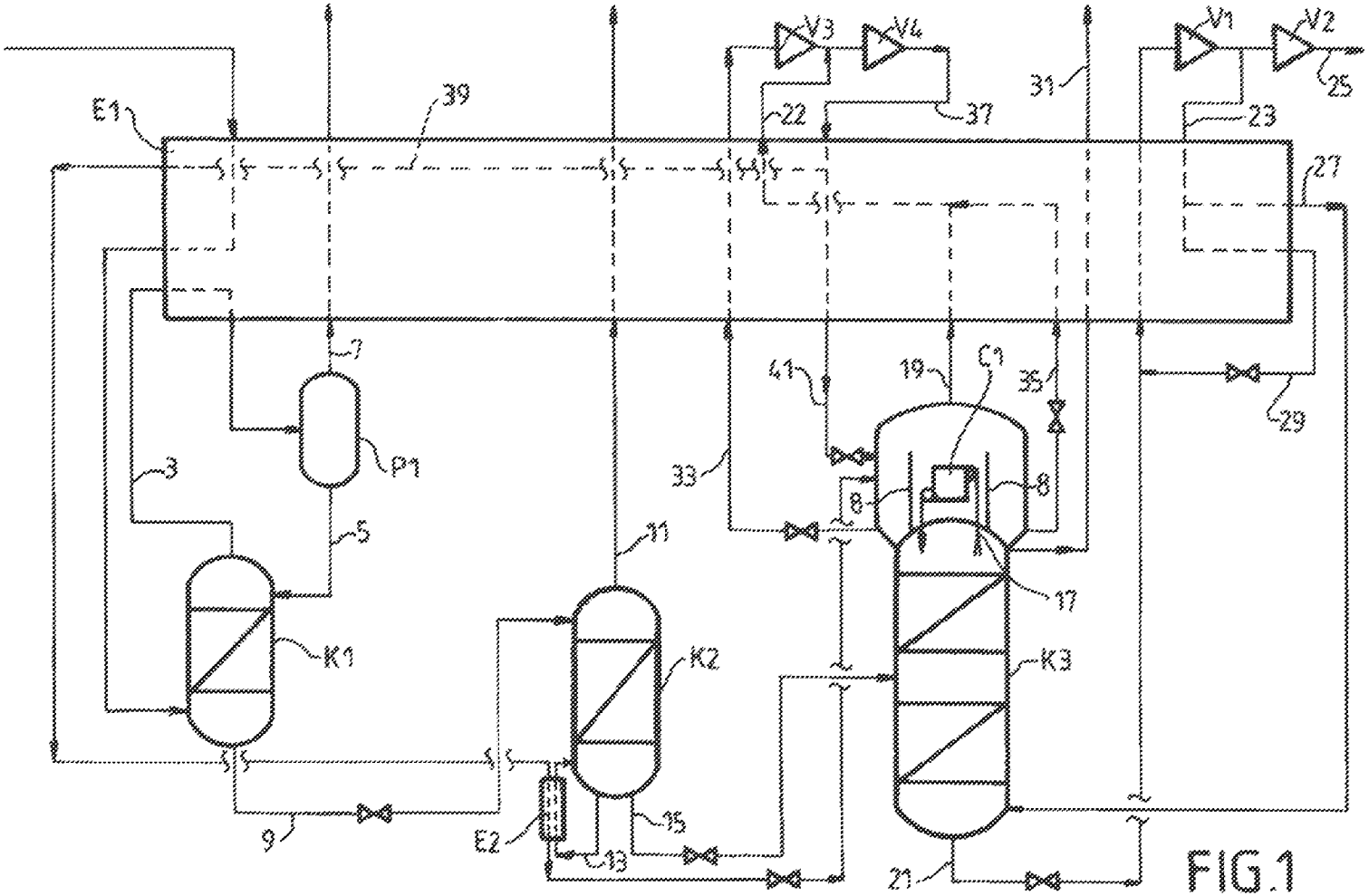
FIG. 1 provides a first embodiment of the present invention.

In FIG. 1, a synthesis gas 1 purified from carbon dioxide and from water is cooled in a heat exchanger E1.

It is cooled down to an intermediate temperature of the exchanger and then feeds the bottom of a CO scrubbing column K1.

A top gas rich in hydrogen 3 is withdrawn at the top of the column K1, cooled in the exchanger E1 and sent, partially condensed, to a phase separator P1. The gas 7 from the separator P1 is reheated in the exchanger E1, while the liquid 5 is returned at the top of the column K1 as reflux. Alternatively or in addition, a liquid originating from the top of the column K3 can be sent to the top of the column K1.

The liquid 5 contains at least 80 mol % of carbon monoxide.

The bottom liquid 9 from the scrubbing column K1 is reduced in pressure and sent to the top of the stripping column K2. The top gas 11 from the column K2 is reheated in the exchanger E1. The bottom liquid 13 is vaporized in the heat exchanger E2 against a part 39 of the cycle nitrogen. The remainder 15 of the bottom liquid is sent to an intermediate point of the $CO/CH_4$ separation column K3. This separation column K3 does not have a bottom reboiler; on the other hand, it does have a top condenser C1. The top carbon monoxide 17 from the column K3 is at least partially condensed in the condenser C1 by exchange of heat with the cycle nitrogen. The condenser C1 is located inside a bath, the walls 8 of which are shown.

The bottom liquid 21 enriched in methane is reduced in pressure and then vaporized in the heat exchanger E1 to form a gas. All the gas is compressed in the compressor V1 and a part of the gas continues the compression in the compressor V2 in order to form the product gas 25 at at least 25 bars abs.

The remainder 23 of the gas compressed in V1 alone is cooled in the heat exchanger and divided into two. A portion 27 is returned to the bottom of the column K3 in order to reboil the column by direct exchange of heat and in order to participate in the distillation.

Another part 29 is cooled down to an intermediate temperature of the exchanger E1 and then joins up with the liquid 21 to be vaporized in the exchanger after reduction in pressure in a valve.

The cycle nitrogen does not participate in the distillation but is used to reboil the column K2 and to condense the top gas 17 from K3. The liquid nitrogen 35 from the condenser C1 is vaporized and is sent to a nitrogen compressor V4. Gaseous nitrogen 19 vaporized by the condenser C1 and is mixed with the vaporized liquid 35 in the exchanger. Another flow of liquid from the bath of the condenser 33 is reduced in pressure to a relatively low pressure and is subsequently compressed in the compressor V3. The nitrogen compressed in V3 joins up with the nitrogen flows 19, 35 and the combined flow is compressed in V4. This compressed flow 37 is cooled in the exchanger and is divided into two. A part 39 is used to heat the exchanger E2 in order to reboil K2. A part 41 is liquefied after cooling in the heat exchanger and is sent to the bath of condenser C1.

The separation column K3 operates at between 1.5 and 15 bars abs, indeed even between 7 and 10 bars abs.

The separation column K3 does not comprise a bottom reboiler.

The scrubbing column K1 operates at between 15 and 60 bars absolute,

The maximum pressure of the cycle of the nitrogen (outlet pressure of V4) is chosen so that the condensation temperature of nitrogen 37 in the heat exchanger E1 at this pressure is lower by less than approximately 10° C. than the vaporization temperature of the liquid methane 21 in the heat exchanger.

Figure 2:
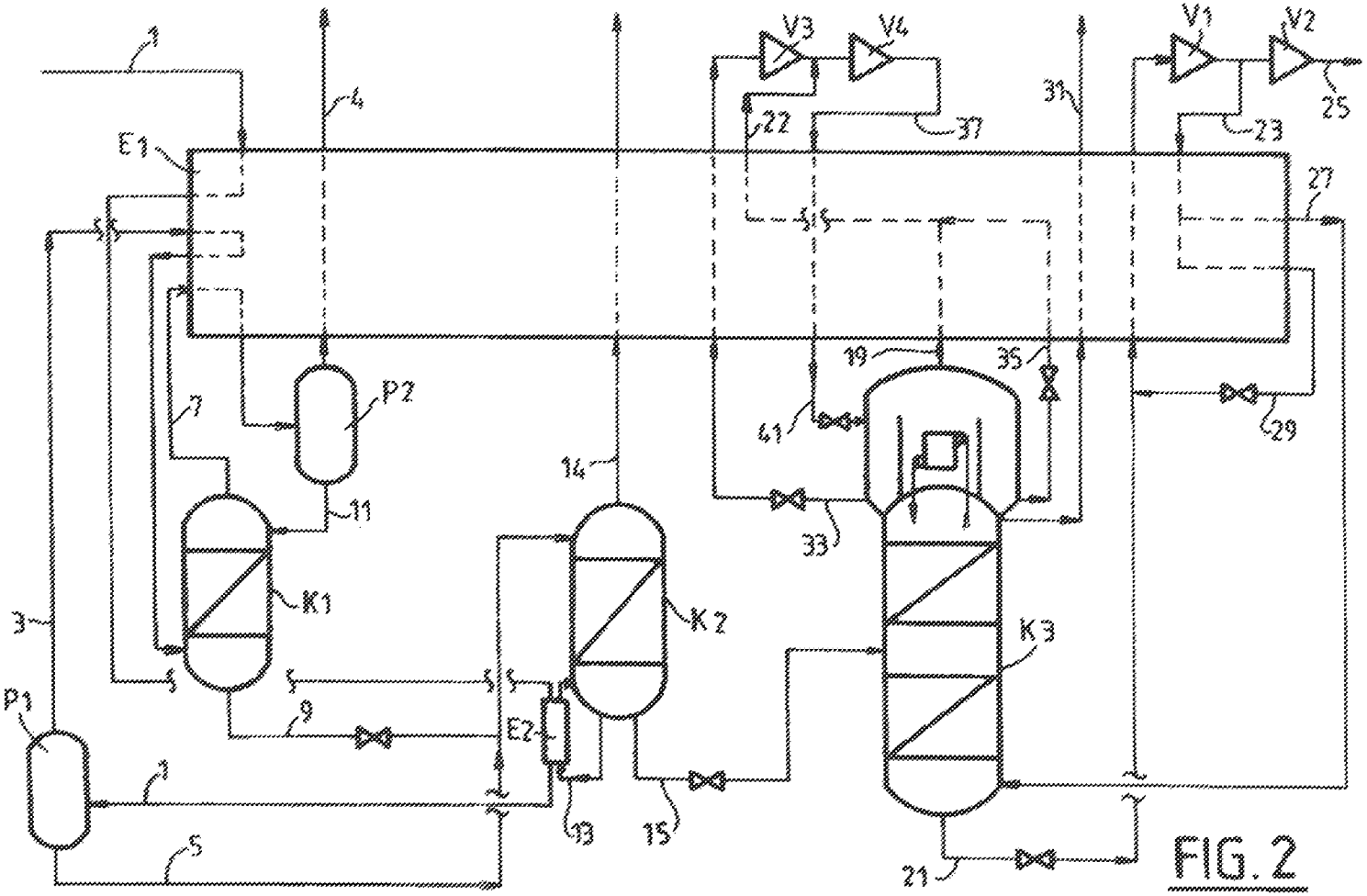
FIG. 2 provides a second embodiment of the present invention.

In FIG. 2, an alternative form of FIG. 1 is encountered where the mixture 1 is used to heat the heat exchanger E2 and thus the bottom of the column K2. The mixture is partially condensed therein, is sent to the separator P1 and the gas formed 3 feeds the column K1.

The liquid 5 from the separator P1 joins up with the liquid 9 from the column K1 and feeds the top of the stripping column K2.

In this instance, all the nitrogen from the compressor V4 is sent to the condenser C1.

Figure 3:
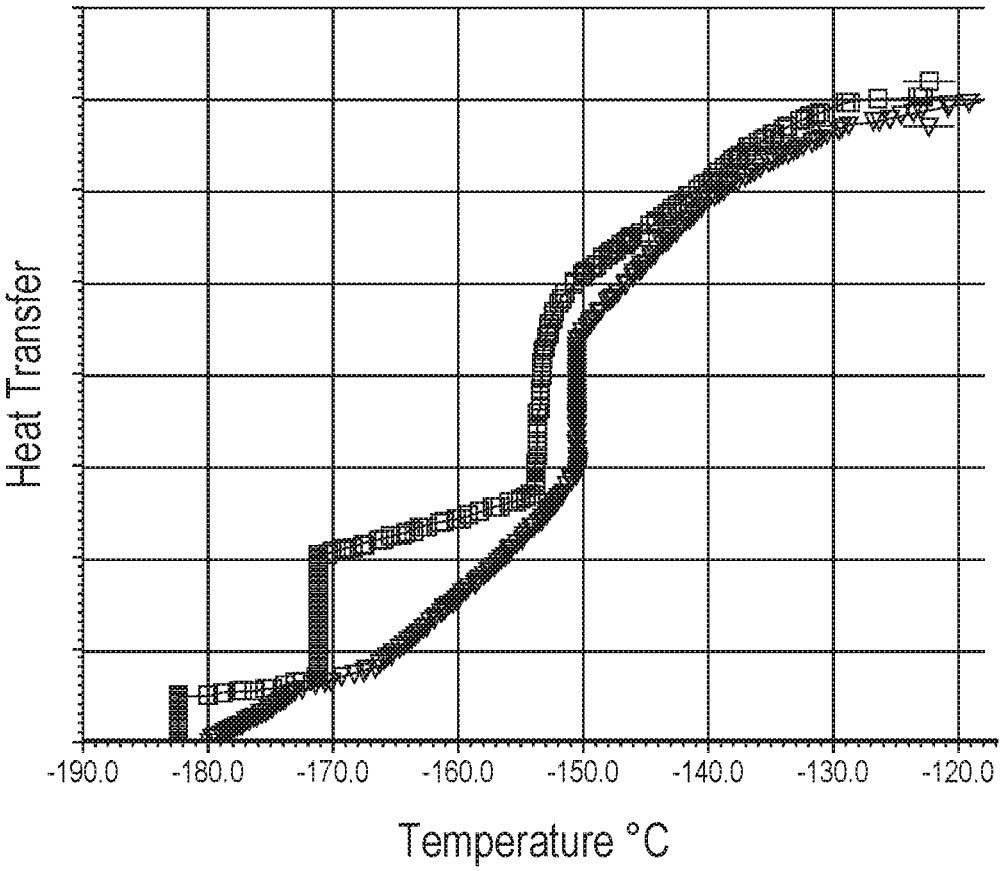
FIG. 3 represents the exchange of heat between the fluids which are cooled and the fluids which are heated within heat exchanger E1 in accordance with an embodiment of the present invention.

As illustrated in FIG. 3, the stationary phase for vaporization of the liquid methane 21 occurs opposite the stationary phase of condensation of the nitrogen originating from the compressor V4 (two vertical lines at between −155° C. and −150° C.) and the exchange diagram indicates particularly noteworthy performance qualities.

However, the presence of the nitrogen cycle is not essential; it can, for example, be replaced by a carbon monoxide cycle.

Figure 4:
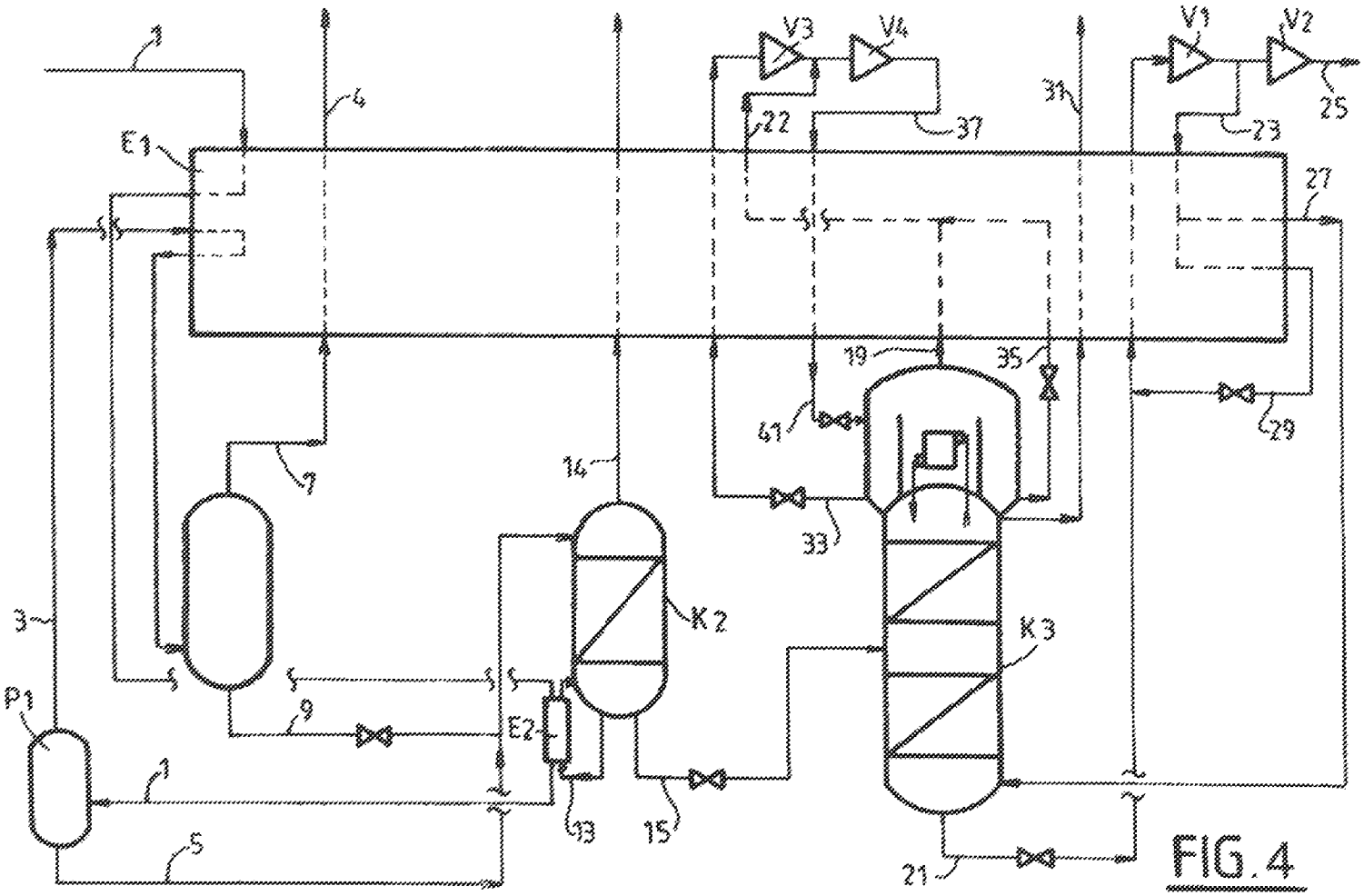
FIG. 4 provides a third embodiment of the present invention.

In FIG. 4, which is an alternative form of FIG. 1, the gas to be treated 1, after having heated the bottom of the column K2 via E2, is first separated in a phase separator P1. The gas formed 3 is cooled in the heat exchanger E1 and subsequently partially condensed in a second phase separator P2. The gas from the separator P2 exits from the apparatus as gas 4. The liquid 9 is reduced in pressure in order to join up with the liquid 5 originating from the first phase separator P1 and the liquid formed feeds the top of the column K2.

Thus, the phase separator and the column of FIG. 1 are replaced with two phase separators.

Figure 5:
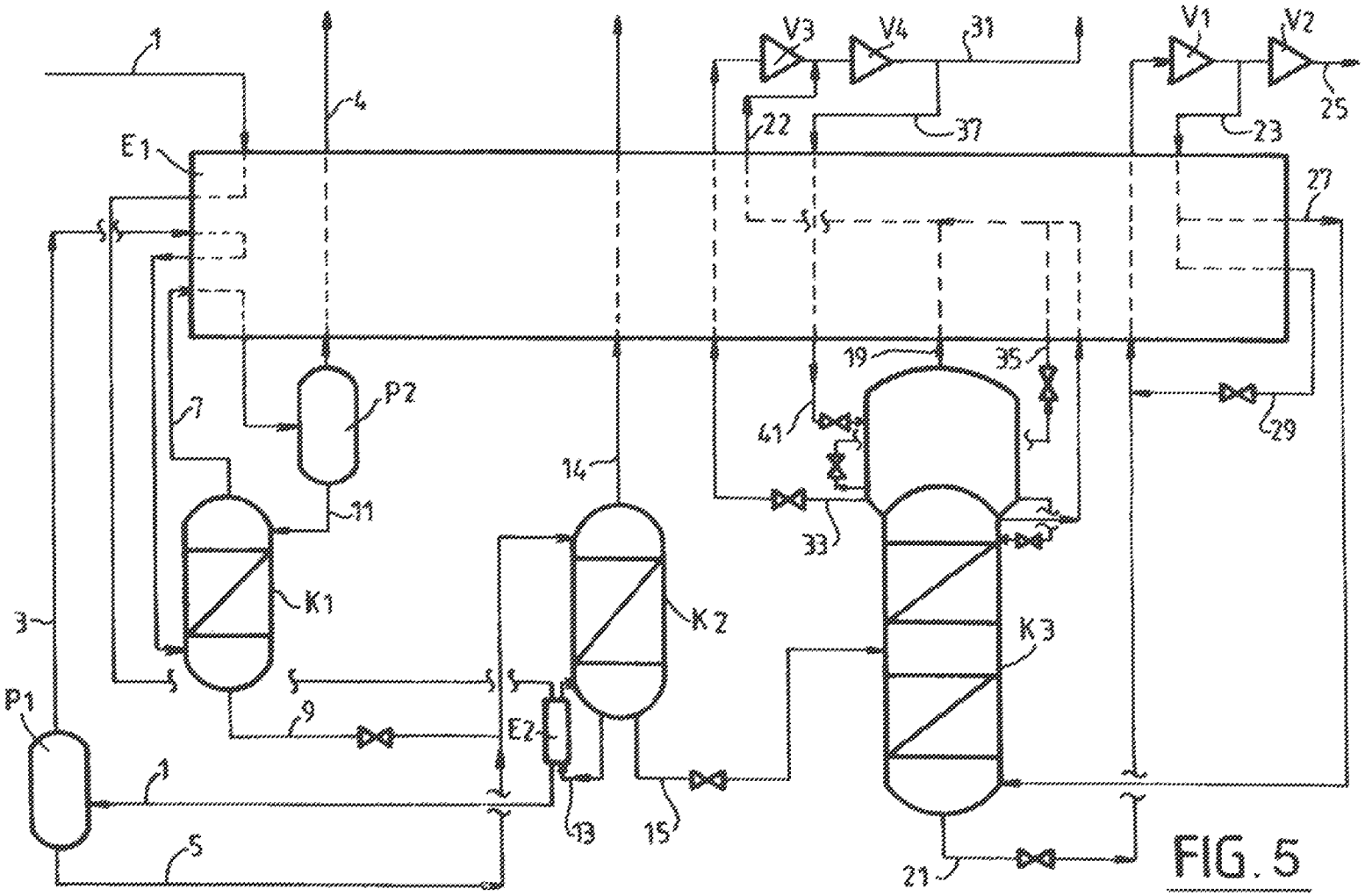
FIG. 5 provides a fourth embodiment of the present invention.

FIG. 5 is an alternative form of FIG. 2 where the column K3 is not surmounted by a condenser of the top gas but by a reservoir of liquid rich in carbon monoxide. This liquid participates in a carbon monoxide cycle. The liquid 33 is withdrawn from the reservoir, reduced in pressure, vaporized in the exchanger E1 and sent to a compressor V3. A top gas 19 from the reservoir is reheated in the exchange E1 as flow 22 and sent to the outlet of the compressor V3 in order to be compressed in the compressor V4. A part 37 of gas compressed in V4 is returned as liquid 41 to the reservoir. A second flow 35 of liquid from the reservoir is reduced to a higher pressure than the inlet of the compressor V3 and is sent to the inlet of V4 also. Top gas from the column K3 is also sent to the inlet of the compressor V4. The flow of pressurized carbon monoxide 31, preferably pressurized to between 10 and 15 bars, is used as product.

Thus, it is seen that the carbon monoxide cycle replaces the closed nitrogen cycle.

Figure 6:
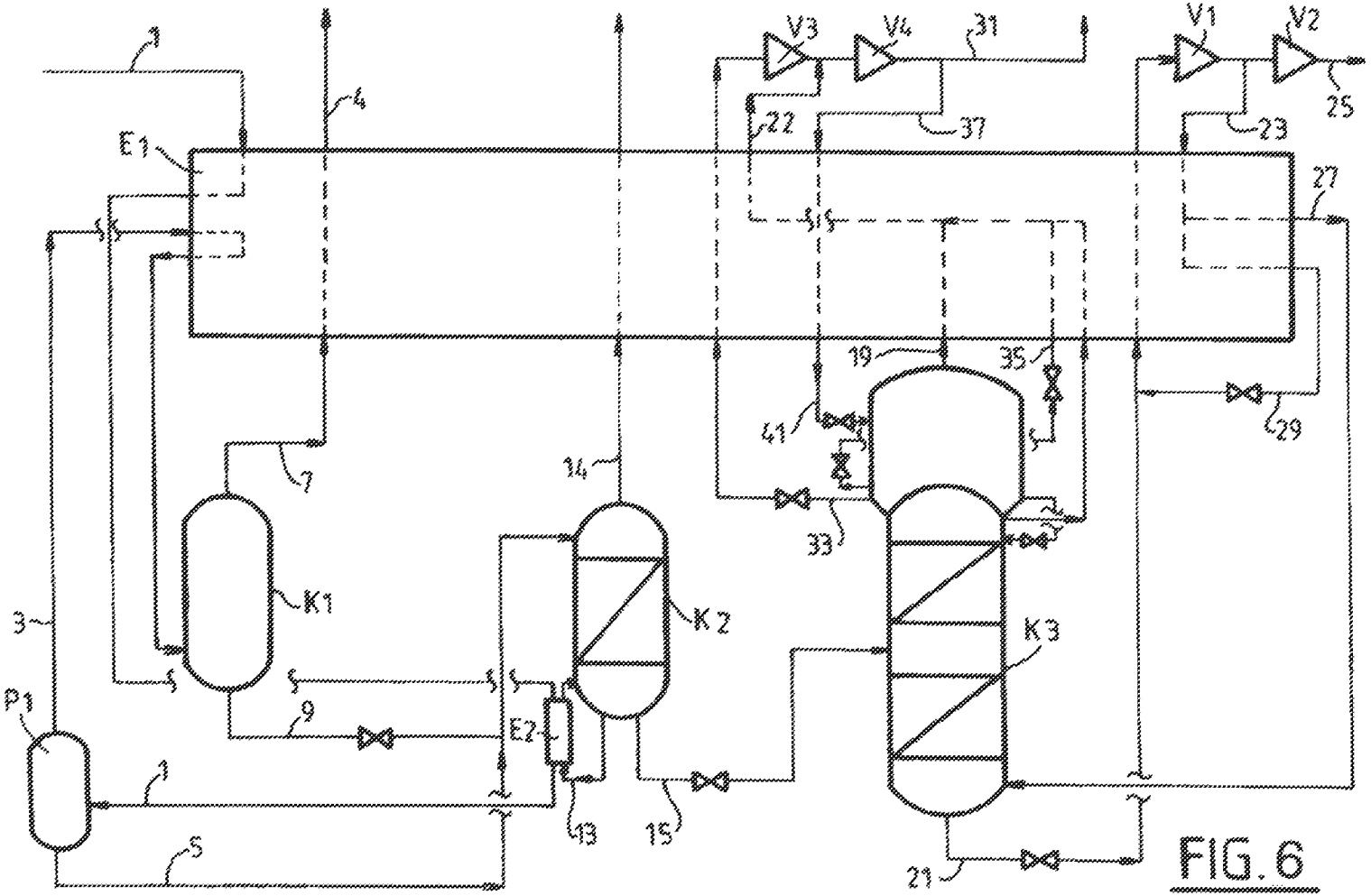
FIG. 6 provides a fifth embodiment of the present invention.

FIG. 6 comprises the carbon monoxide cycle of FIG. 5 and the two phase separators of FIG. 4.

Figure 7:
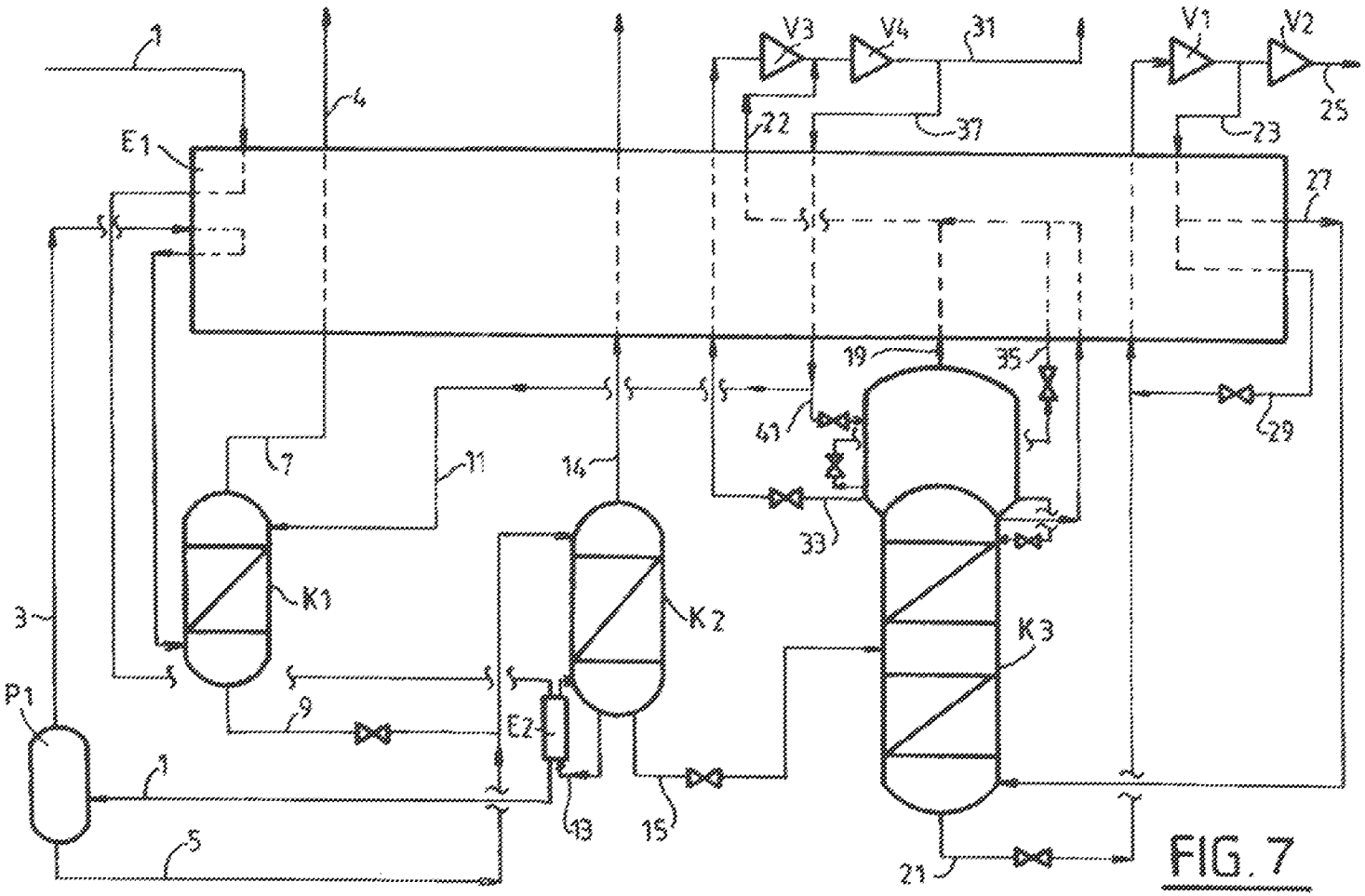
FIG. 7 provides a sixth embodiment of the present invention.

For the cases with carbon monoxide cycle, for example in FIGS. 5 and 6, it is possible, as illustrated in FIG. 7, to take liquid carbon monoxide 37 at the outlet pressure of the compressor V4, to condense it and to send at least a part 11 to the top of the column K1.

The remainder 41 of the liquid can be returned to the top reservoir of the column K3. The liquid 11 preferably contains at least 80 mol % of carbon monoxide.

In the case of the presence of nitrogen, a $CO/N_2$ separation column can be added upstream or downstream of the column K3.

For all the figures:

the scrubbing column K1 operates at between 15 and 60 bars absolute, the stripping column K2 operates at between 3 and 20 bars absolute, the separation column operates at between 1.5 and 15 bars absolute, the maximum pressure of the nitrogen cycle (outlet pressure of V4) is 35 bars absolute (critical pressure of the nitrogen). The process is possible with a pressure of greater than and up to 70 bars but less effective if above the critical pressure of the nitrogen.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for separation of a mixture comprising carbon monoxide, hydrogen and methane, the process comprising the steps of:

i) sending the mixture or a fluid derived from the mixture, after cooling to a cryogenic temperature in a heat exchanger, to a scrubbing column fed at a top portion with a liquid containing at least 80 mol % carbon monoxide or to at least one phase separator;

ii) withdrawing a bottom liquid at a bottom portion of the scrubbing column or of the phase separator or of one of the phase separators that is depleted in hydrogen with respect to the mixture and then sending the bottom liquid to a stripping column;

iii) withdrawing a gas at a top portion of the stripping column;

iv) sending a bottom liquid from the stripping column to a separation column that is configured to separate the bottom liquid into a top gas enriched in carbon monoxide and a liquid enriched in methane; and v) withdrawing the liquid enriched in methane from a bottom portion of the separation column and then vaporizing the liquid enriched in methane in the heat exchanger in order to form gaseous methane, wherein the gaseous methane is compressed in a compressor and a first part of the gaseous methane following compression is returned at the bottom of the separation column for separation therein, and a second part of the gaseous methane following compression is collected as a compressed methane product stream, wherein the separation column has a top condenser cooled by a closed nitrogen cycle comprising a gaseous nitrogen compressor or by a closed carbon monoxide cycle comprising a gaseous carbon monoxide compressor, wherein the first part of the gaseous methane following compression that is returned to the bottom of the separation column has the same methane concentration as the liquid enriched in methane withdrawn the bottom portion of the separation column.

2. The process according to claim 1, in which the first part of the gaseous methane following compression is at a lower pressure than that of the compressed methane product stream.

3. The process according to claim 1, wherein the liquid fed to the top portion of the scrubbing column comprises condensate formed from at least a part of a gas from the top portion of the scrubbing column.

4. The process according to claim 1, in which the mixture contains nitrogen and in which the separation column produces, at the bottom portion, the liquid enriched in methane and depleted in carbon monoxide and, at the top portion, the top gas enriched in carbon monoxide.

5. The process according to claim 1, in which the nitrogen cycle is used to reboil the stripping column.

6. The process according to claim 1, in which a maximum pressure of the nitrogen or carbon monoxide cycle is less than the critical pressure of the nitrogen or the critical pressure of the carbon monoxide.

7. The process according to claim 1, in which a maximum pressure of the nitrogen or carbon monoxide cycle is chosen so that a condensation temperature of nitrogen or carbon monoxide in the heat exchanger at the maximum pressure is within 10° C. warmer than a vaporization temperature of the liquid methane in the heat exchanger.

8. The process according to claim 1, in which the mixture or the fluid derived from the mixture is used to reboil the stripping column.

9. The process according to claim 1, in which the separation column operates at between 1.5 and 15 bars abs.

10. An apparatus for separation of a mixture comprising carbon monoxide, hydrogen and methane, the apparatus comprising:

a scrubbing column having a top portion and/or at least one phase separator;

a stripping column having a top portion and a bottom portion;

a separation column having a top portion and a bottom portion;

a heat exchanger;

means for sending the mixture to be cooled to a cryogenic temperature to the heat exchanger;

means for sending the cooled mixture or a fluid derived from said cooled mixture to the scrubbing column fed at the top portion with a liquid containing at least 80 mol % carbon monoxide and/or to at least one phase separator;

means for withdrawing a bottom liquid from the scrubbing column and/or the at least one phase separator, wherein the bottom liquid is depleted in hydrogen with respect to the mixture;

means for sending the withdrawn bottom liquid to the stripping column;

means for withdrawing a gas at the top portion of the stripping column;

means for sending a bottom liquid from the stripping column to the separation column, wherein the separation column is configured to separate the bottom liquid into a top gas enriched in carbon monoxide and a liquid enriched in methane;

means for withdrawing the liquid enriched in methane from the bottom of the separation column, wherein the means for withdrawing the liquid enriched in methane are in fluid communication with the heat exchanger in order to form gaseous methane;

a compressor;

means for sending the gaseous methane to the compressor; and means for returning a part of the gaseous methane following compression in the compressor to the bottom portion of the separation column for separation therein, wherein the separation column comprises a top condenser that is cooled by a closed refrigeration cycle, wherein the closed refrigeration cycle is selected from the group consisting of a closed nitrogen refrigeration cycle and a closed carbon monoxide refrigeration cycle, wherein the part of the gaseous methane following compression that is returned to the bottom of the separation column has the same methane concentration as the liquid enriched in methane withdrawn the bottom portion of the separation column.

11. The apparatus according to claim 10, wherein the closed refrigeration cycle comprises the closed nitrogen cycle comprising a gaseous nitrogen compressor.

12. The apparatus according to claim 10, wherein the closed refrigeration cycle comprises the closed carbon monoxide cycle comprising a gaseous carbon monoxide compressor.

13. The apparatus according to claim 10, in which the means for returning the part of the gas compressed in the compressor at the bottom portion of the separation column are connected to the heat exchanger.

14. The apparatus according to claim 10, wherein the separation column comprises an absence of a reboiler.

15. The process according to claim 1, wherein the separation column comprises an absence of a reboiler.

* * * * *